US009649639B2

(12) United States Patent
El-Fahmawi

(10) Patent No.: US 9,649,639 B2
(45) Date of Patent: May 16, 2017

(54) SEPARATION APPARATUS AND METHODS OF SEPARATING MAGNETIC MATERIAL

(71) Applicant: Bassam El-Fahmawi, Fremont, CA (US)

(72) Inventor: Bassam El-Fahmawi, Fremont, CA (US)

(73) Assignee: Corning Incorporated, Corning, NY (US)

( * ) Notice: Subject to any disclaimer, the term of this patent is extended or adjusted under 35 U.S.C. 154(b) by 633 days.

(21) Appl. No.: 13/754,139

(22) Filed: Jan. 30, 2013

(65) Prior Publication Data

US 2013/0199970 A1 Aug. 8, 2013

Related U.S. Application Data

(60) Provisional application No. 61/594,552, filed on Feb. 3, 2012.

(51) Int. Cl.
*B03B 9/00* (2006.01)
*B03C 1/02* (2006.01)
(Continued)

(52) U.S. Cl.
CPC *B03C 1/02* (2013.01); *B01L 9/50* (2013.01); *B03C 1/032* (2013.01); *B03C 1/286* (2013.01);
(Continued)

(58) Field of Classification Search
CPC ..... B03C 1/0332; B03C 1/28; B03C 2201/18; B03C 2201/26; E05Y 2600/502;
(Continued)

(56) References Cited

U.S. PATENT DOCUMENTS 4,148,721 A * 4/1979 Brown et al. ..... 209/728
4,895,650 A * 1/1990 Wang ..... 210/222
(Continued)

FOREIGN PATENT DOCUMENTS

WO 2004048285 A1 6/2004

OTHER PUBLICATIONS

Sonja Berensmeier, Magnetic particles for the separation and purification of nucleic acids, Applied Microbiology and Biotechnology Dec. 2006, vol. 73, Issue 3, pp. 495-504.
(Continued)

*Primary Examiner* — Joseph C Rodriguez
*Assistant Examiner* — Kalyanavenkateshware Kumar
(74) *Attorney, Agent, or Firm* — Susan S. Wilks; John P. Ciccarelli

(57) ABSTRACT

A separation apparatus comprises a base defining a mounting surface with a length and a width. The separation apparatus further includes a pair of clamps configured for toolless operation. The pair of clamps are spaced apart from one another along the length of the mounting surface and configured to inhibit a movement of the sample plate relative to the mounting surface. In further examples, methods of separating a magnetic material within containment areas of a sample plate are provided including the step of clamping a first edge portion of the sample plate with the spring clip and clamping a second edge portion of the sample plate with a jaw mechanism. The method further includes the step of inverting the base together with the sample plate such that liquid drains from the containment areas while magnetic material remains in the containment areas under the influence of respective magnets.

22 Claims, 9 Drawing Sheets

(51) Int. Cl.
*B03C 1/032* (2006.01)
*B03C 1/28* (2006.01)
*B01L 9/00* (2006.01)

(52) U.S. Cl.
CPC ..... *B01L 9/52* (2013.01); *B03C 2201/18* (2013.01); *E05Y 2600/502* (2013.01)

(58) Field of Classification Search
CPC G01N 35/0098; G01N 33/54326; B01L 3/52; B01L 3/561; B01L 9/50; B01L 9/52; B01L 9/523; B01L 9/527
USPC ..... 209/214, 215, 223.1; 210/222, 223, 695; 15/252, 253
See application file for complete search history.

(56) References Cited

U.S. PATENT DOCUMENTS 5,443,791 A * 8/1995 Cathcart et al. ..... 422/65
5,567,326 A * 10/1996 Ekenberg et al. ..... 210/695
5,779,907 A * 7/1998 Yu ..... 210/695
6,672,458 B2 * 1/2004 Hansen et al. ..... 209/224
7,620,276 B2 11/2009 Schulz
8,685,322 B2 * 4/2014 Griebel et al. ..... 422/67
2007/0000826 A1 * 1/2007 Stevens ..... B30B 5/02 210/153
2008/0204713 A1 8/2008 Indermuehle et al.
2012/0128459 A1 * 5/2012 Hoyer ..... B01L 9/523 414/783
2013/0011224 A1 * 1/2013 Hoyer ..... B01F 11/0008 414/222.01

OTHER PUBLICATIONS

Ivo Safarik et al., Magnetic techniques for the isolation and purification of proteins and peptides, BioMagnetic Research and Technology 2004, 2:7, pp. 1-17.
Magnetic Bead Separation for Every Microplate, V&P Scientific, Inc.; Downloaded from the internet Mar. 1, 2013; Copyright 2010; http://vp-scientific.com/Magnetic_Bead_Separation_Microplates.php; 27 pages.

* cited by examiner

SEPARATION APPARATUS AND METHODS OF SEPARATING MAGNETIC MATERIAL

CROSS-REFERENCE TO RELATED APPLICATIONS

This application claims the benefit of priority under 35 U.S.C. §119 of U.S. Provisional Application Ser. No. 61/594,552 filed on Feb. 3, 2012 the content of which is relied upon and incorporated herein by reference in its entirety.

FIELD

The present invention relates generally to separation apparatus and methods and, more particularly, to separation apparatus for separating magnetic material and methods of separating magnetic material.

BACKGROUND

Magnetic bead based separation is widely used for the purification of macromolecules such as nucleic acid and protein purification applications. Conventional separation apparatus are known to be used with methods involving multiple pipetting steps.

SUMMARY

The following presents a simplified summary of the disclosure in order to provide a basic understanding of some example aspects described in the detailed description.

In one example aspect, a separation apparatus comprises a base defining a mounting surface with a length and a width. The mounting surface faces an outward direction extending along a mounting axis of the base. The base includes a first pair of stops configured to inhibit a movement of a sample plate relative to the mounting surface along the width of the mounting surface. The separation apparatus further includes a pair of clamps configured for toolless operation. The pair of clamps are spaced apart from one another along the length of the mounting surface and configured to inhibit movement of the sample plate relative to the mounting surface in the outward direction away from the mounting surface.

In one example of the aspect, the pair of clamps includes a spring clip configured to be biased to an engaged position to facilitate mounting of the sample plate relative to the mounting surface to inhibit movement of the sample plate relative to the mounting surface in the outward direction. The spring clip can be pivoted to a disengaged position without tools to facilitate movement of the sample plate relative to the mounting surface in the outward direction.

In another example of the aspect, the pair of clamps includes a jaw configured to translate along the mounting axis, and a locking device configured to lock the jaw in a desired position to inhibit movement of the sample plate relative to the mounting surface in the outward direction.

In still another example of the aspect, the locking device comprises a thumb screw.

In yet another example of the aspect, the base includes a clamp member including an elongated slot extending along the mounting axis and defining a travel path for a shank of the thumb screw.

In another example of the aspect, the base includes a clamp member including an elongated groove extending along the mounting axis and defining a travel path for a mounting member of the jaw.

In still another example of the aspect, the separation apparatus includes a magnetic plate comprising a plurality of magnets, wherein the magnetic plate is mounted to the base such that the magnetic plate extends along the mounting surface of the base.

In one example of the aspect, the magnetic plate is removably mounted to the base.

In another example of the aspect, the first pair of stops inhibits a movement of the magnetic plate relative to the mounting surface along the width of the mounting surface.

In still another example of the aspect, the base includes a second pair of stops that inhibit a movement of the magnetic plate relative to the mounting surface along the length of the mounting surface. In one example, each of the second pair of stops includes a corresponding one of the pair of clamps.

In another example aspect, a separation apparatus comprises a base defining a mounting surface with a length and a width. The mounting surface faces an outward direction extending along a mounting axis of the base. The base includes a first pair of stops configured to inhibit a movement of a sample plate relative to the mounting surface along the width of the mounting surface. The separation apparatus further includes a pair of clamps configured for toolless operation. The pair of clamps are spaced apart from one another along the length of the mounting surface and configured to inhibit movement of the sample plate relative to the mounting surface in the outward direction away from the mounting surface in the outward direction. A first one of the pair of clamps includes a spring clip configured to be biased to an engaged position to facilitate mounting of the sample plate relative to the mounting surface to inhibit movement of a first edge portion of the sample plate relative to the mounting surface in the outward direction. The spring clip can be pivoted to a disengaged position without tools to facilitate movement of the first edge portion of the sample plate relative to the mounting surface in the outward direction. A second one of the pair of clamps includes a jaw configured to translate along the mounting axis, and a locking device configured to lock the jaw in a desired position to inhibit movement of a second edge portion of the sample plate relative to the mounting surface in the outward direction.

In one example of the aspect, the separation apparatus includes a magnetic plate comprising a plurality of magnets, wherein the magnetic plate is mounted to the base such that the magnetic plate extends along the mounting surface of the base.

In another example of the aspect, the first pair of stops inhibits a movement of the magnetic plate relative to the mounting surface along the width of the mounting surface.

In another example aspect, a method of separating magnetic material within containment areas of a sample plate comprises the step (I) of providing a separation apparatus including a base defining a mounting surface with a length and a width. The mounting surface faces an outward direction extending along a mounting axis of the base. The separation apparatus further includes a plurality of magnets positioned along the mounting surface of the base. The separation apparatus further includes a pair of clamps with a spring clip and a jaw mechanism. The method further includes the step (II) of engaging a press portion of the spring clip to force the spring clip to pivot to a disengaged position. The method further includes the step (III) of positioning the sample plate such that each containment area is positioned within a magnetic field of at least one of the magnets. The sample plate includes a first edge portion and a second edge portion opposed to the first edge portion, wherein the first edge portion is positioned with respect to the spring clip and a second edge portion positioned with respect to the jaw. The method further includes the step (IV) of clamping the first edge portion of the sample plate with the spring clip by releasing the spring clip to allow the spring clip to be biased to engage the first edge portion of the sample plate. The method further includes the step (V) of clamping the second edge portion of the sample plate with the jaw mechanism by translating a jaw of the jaw mechanism along the mounting axis to engage the second edge portion of the sample plate, and then locking the jaw from further translation along the mounting axis. The method further includes the step (VI) of inverting the base together with the sample plate such that liquid drains from the containment areas while magnetic material remains in the containment areas under the influence of the respective magnets.

In one example of the aspect, the method further includes the step of engaging an outer surface of the inverted sample plate against an absorbent material after step (VI).

In another example of the aspect, the method further includes the step of rinsing the magnetic material that remains after step (VI).

In still another example of the aspect, step (IV) and step (V) are carried out without tools.

In yet another example of the aspect, an operator with two hands carries out step (IV) with one hand and then carries out step (V) with the other hand.

In still another example of the aspect, an operator with two hands carries out step (II) with one hand, and then carries out step (III) with the other hand while carrying out step (II).

BRIEF DESCRIPTION OF THE DRAWINGS

These and other features, aspects and advantages of the present disclosure are better understood when the following detailed description is read with reference to the accompanying drawings, in which.

DETAILED DESCRIPTION

Figure 1:
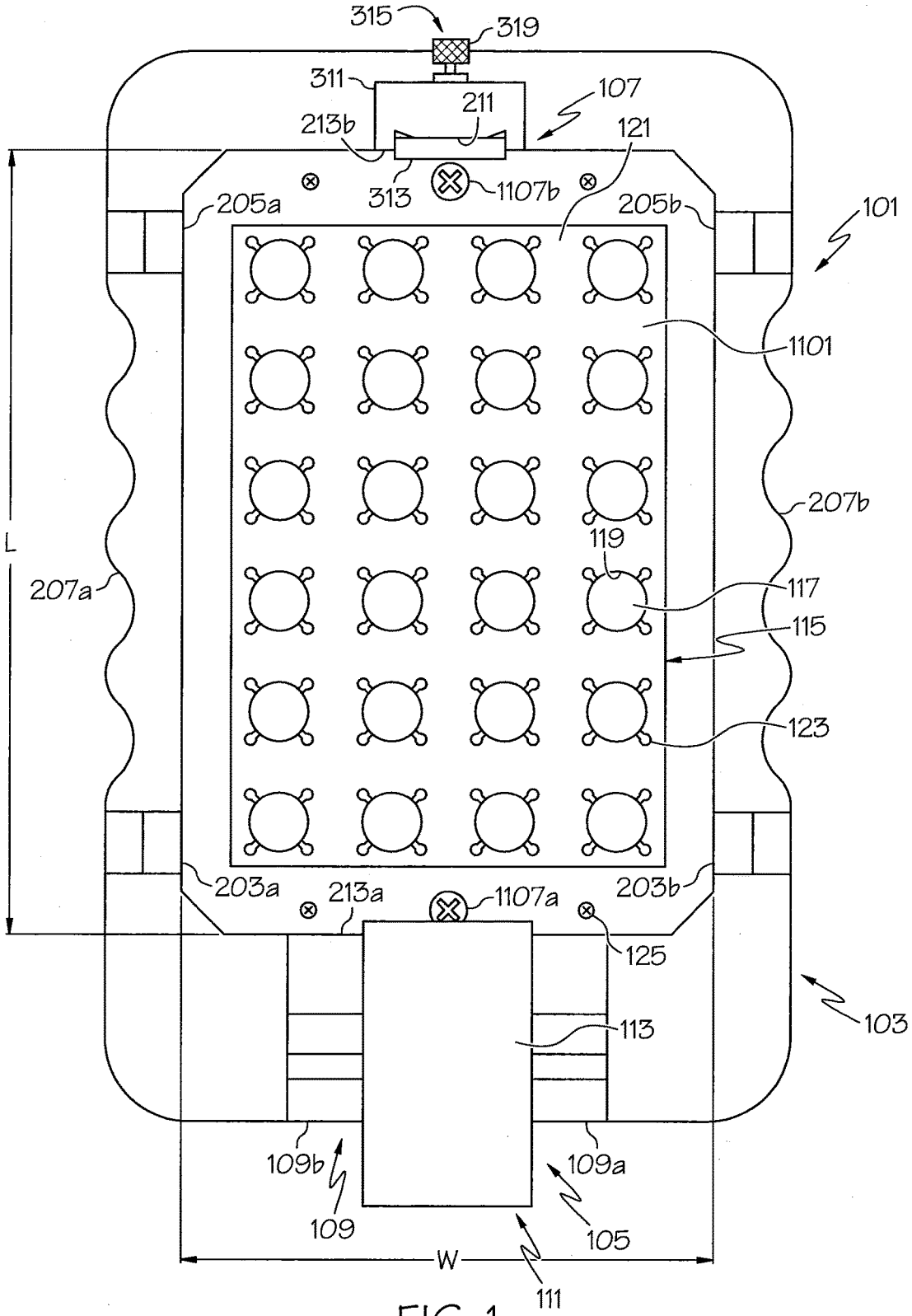
FIG. 1 illustrates a top view of a separation apparatus in accordance with aspects of the disclosure.

Methods will now be described more fully hereinafter with reference to the accompanying drawings in which example embodiments of the disclosure are shown. Whenever possible, the same reference numerals are used throughout the drawings to refer to the same or like parts. However, this disclosure may be embodied in many different forms and should not be construed as limited to the embodiments set forth herein.

Figure 2:
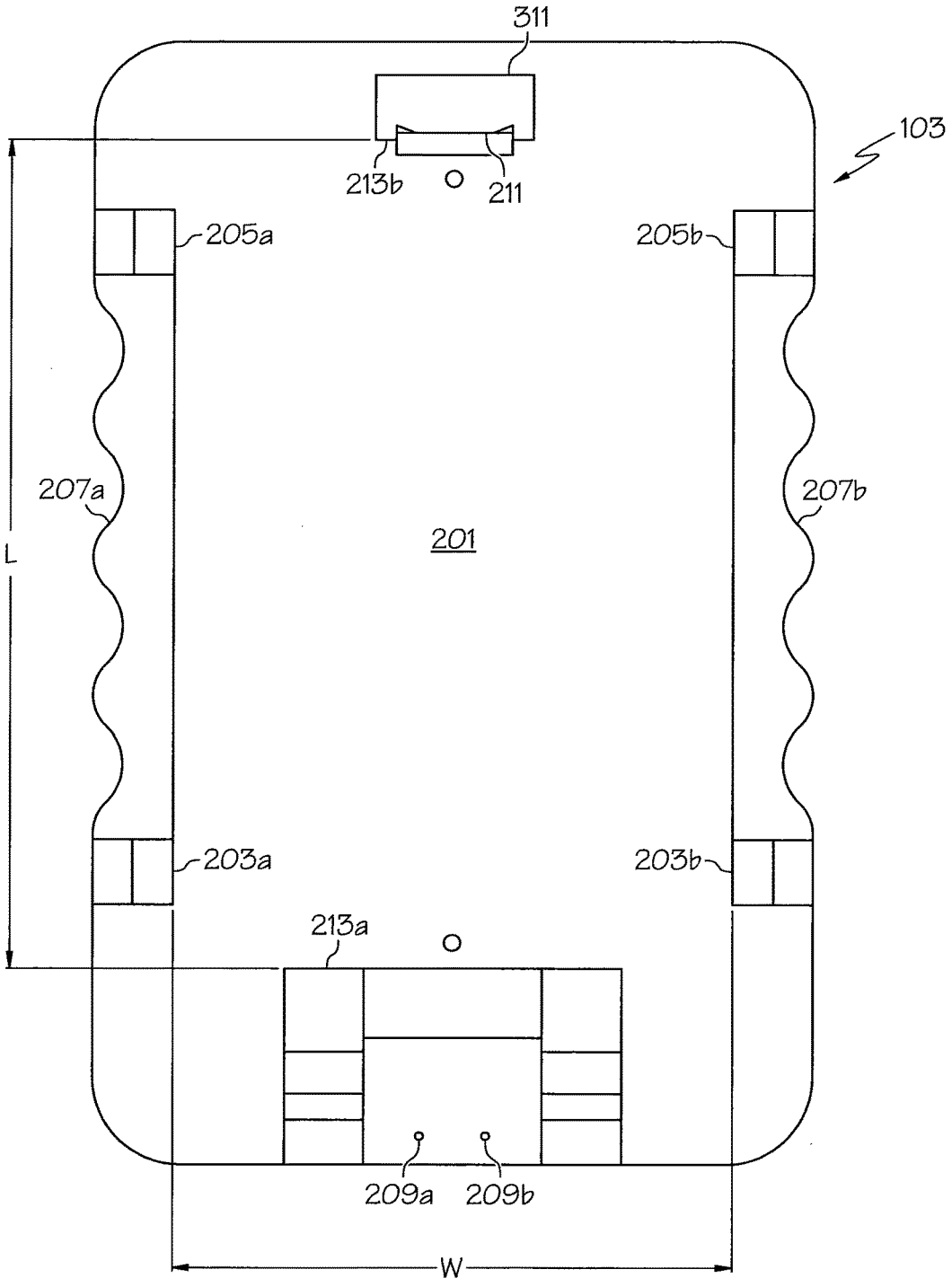
FIG. 2 is a top view of a base of the separation apparatus of FIG. 1.
Figure 3:
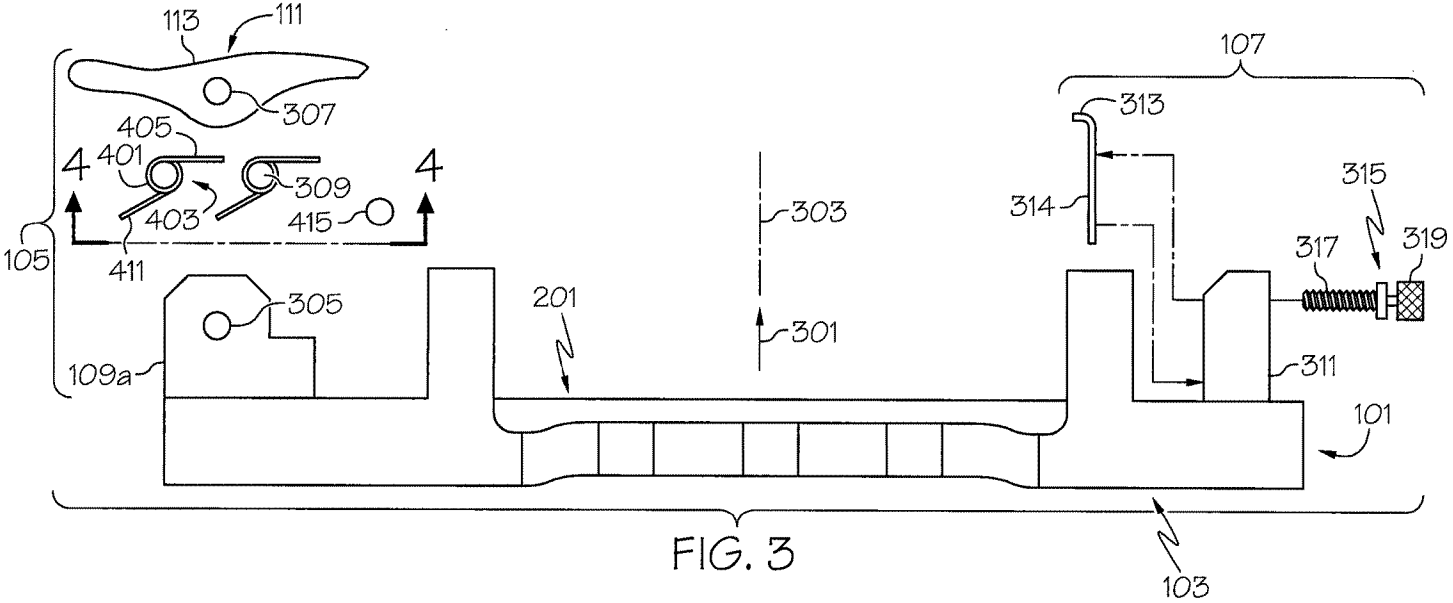
FIG. 3 is an exploded side view of portions of the separation apparatus of FIG. 1.

FIG. 1 illustrates on example separation apparatus 101 in accordance with aspects of the present disclosure. The separation apparatus 101 can include a base 103. FIG. 2 illustrates the base 103 disassembled from the remaining components of the separation apparatus 101 for clarity. As shown, the base 103 includes a mounting surface 201 with a length "L" and a width "W". As shown in FIG. 3, the mounting surface 201 faces an outward direction 301 extending along a mounting axis 303 of the base 103. As shown, the mounting axis 303 can extend substantially perpendicular to the mounting surface 201 although the mounting axis 303 may extend at other angles relative to the mounting surface 201 in further examples.

Turning back to FIG. 2, the base 103 can include at least one pair of stops configured to inhibit a movement of a sample plate. For example, as shown in FIG. 1, the base 103 can include a first pair of stops 203*a*, 203*b* configured to inhibit a movement of a sample plate relative to the mounting surface 201 along the width "W" of the mounting surface 201. As further shown, another pair of stops 205*a*, 205*b* may be provided and further configured to inhibit a movement of a sample plate relative to the mounting surface 201 along the width "W" of the mounting surface 201. Although two lateral pairs of stops are shown, in further examples, a single pair of lateral stops may be provided. For example, the first pair of stops 203*a*, 203*b* may be provided without the additional pair of stops 205*a*, 205*b*. In another example, the pair of stops 205*a*, 205*b* may be provided without the pair of stops 203*a*, 203*b*. Furthermore, if a single pair of first stops is provided, the stops may be moved to the central area of the mounting surface 201. In further examples, a single pair of stops may be provided that are spaced apart from one another along the length "L" of the mounting surface 201. For instance, in one example, the first pair of stops may comprise the stops 203*a*, 205*b* without the other stops 205*a*, 203*b*. Likewise, on another example, the first pair of stops may comprise the stops 205*a*, 203*b* without the other stops 203*a*, 205*b*. Providing a single pair of first stops (rather than the illustrated two pairs of first stops) can simplify the design while still providing the function of limiting a movement along the width "W" of the sample plate relative to the mounting surface 201.

The base 103 can be configured to be held by the hand of an operator. In one example, optional grip contours 207*a*, 207*b* may be provided. The grip contours 207*a*, 207*b*, if provided, can give an indication of how an operator can grasp the base with one hand. Furthermore, the illustrated contour can be designed to accommodate the fingers of a user to allow the user to easily grip the base across the width "W" of the base 103. The base can comprise a wide range of materials. In one example, the base can comprise a polymeric material, resin or other material. In further examples, the base can comprise a nonferrous material.

The separation apparatus can further include a pair of clamps configured for toolless operation, wherein the pair of clamps are spaced apart from one another along the length of the mounting surface and configured to inhibit movement of the sample plate relative to the mounting surface in the outward direction away from the mounting surface. For example, FIG. 1 illustrates one of the pair of clamps comprising a spring clip 105 with the other one of the pair of clamps comprising a jaw mechanism 107.

Figure 4:
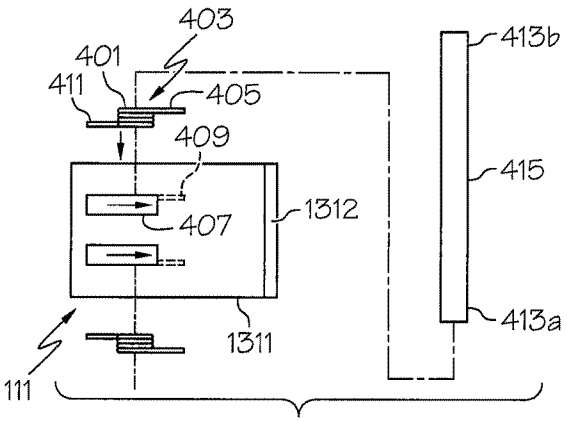
FIG. 4 illustrates an exploded view of portions of an example spring clip of the separation apparatus taken along line 4-4 of FIG. 3.

As shown in FIG. 1, the spring clip 105 can include a pivot support structure 109 that may be part of the base 103. The pivot support structure 109 can include a pair of pivot members 109*a*, 109*b* configured to receive a central portion 113 of a clip member 111 therebetween. Each pivot member 109*a*, 109*b* can include a mounting aperture (e.g., see mounting aperture 305 shown in FIG. 3). As shown in FIG. 4, the spring clip 105 can be assembled by inserting the coil 401 of each torsion spring 403 into a corresponding cavity 407 in the clip member 111. Once inserted, an end 405 of the torsion spring 403 can be received within a retaining aperture 409 within the cavity 407. The torsion springs 403 can then be preloaded and the central portion 113 of the clip member 111 can be inserted between the pivot members 109*a*, 109*b* such that the other end 411 is inserted within a corresponding one of the retaining apertures 209*a*, 209*b* formed in the base 103 as shown in FIG. 2. Next, with reference to FIGS. 3 and 4, a first end 413*a* of a pivot pin 415 can be inserted through the mounting aperture 305 of a first pivot member 109*a*, through a pivot aperture 307 of the central portion 113 of the clip member 111 and the central openings 309 of the coils 401 within the cavities 407 and mounted within the mounting aperture 305 of a second pivot member 109*b*. Once inserted, the first end 413*a* of the pivot pin 415 can be press fit within the aperture 305 of the second pivot member 109*b* and/or a second end 413*b* of the pivot pin 415 can be press fit within the aperture 305 of the first pivot member 109*a*.

Figure 5:
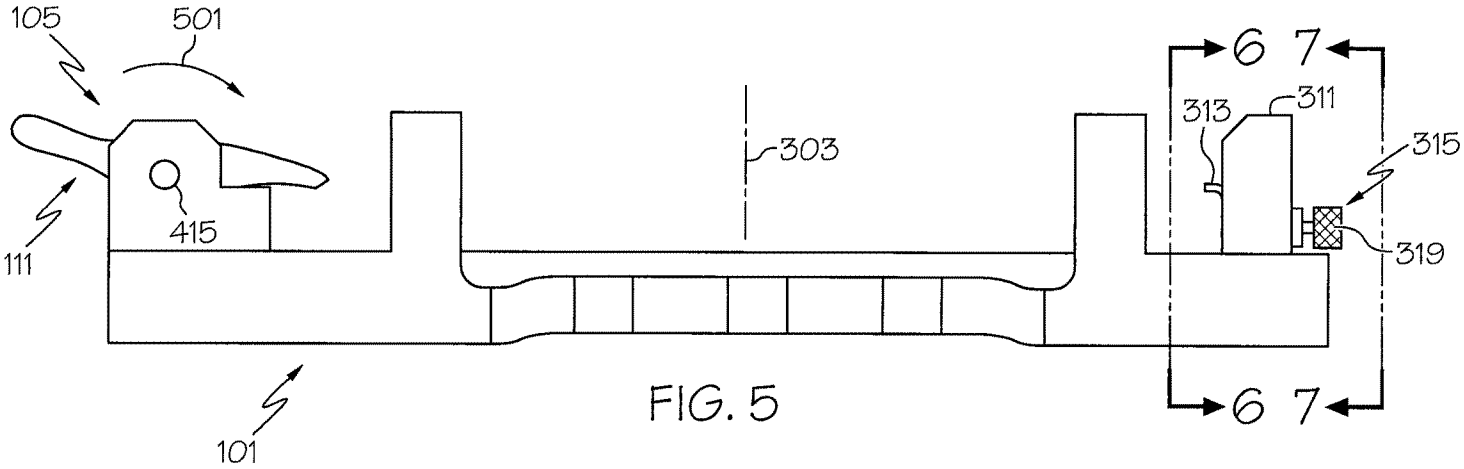
FIG. 5 is an assembled view of the separation apparatus of FIG. 3 in a fully clamped orientation.
Figure 8:
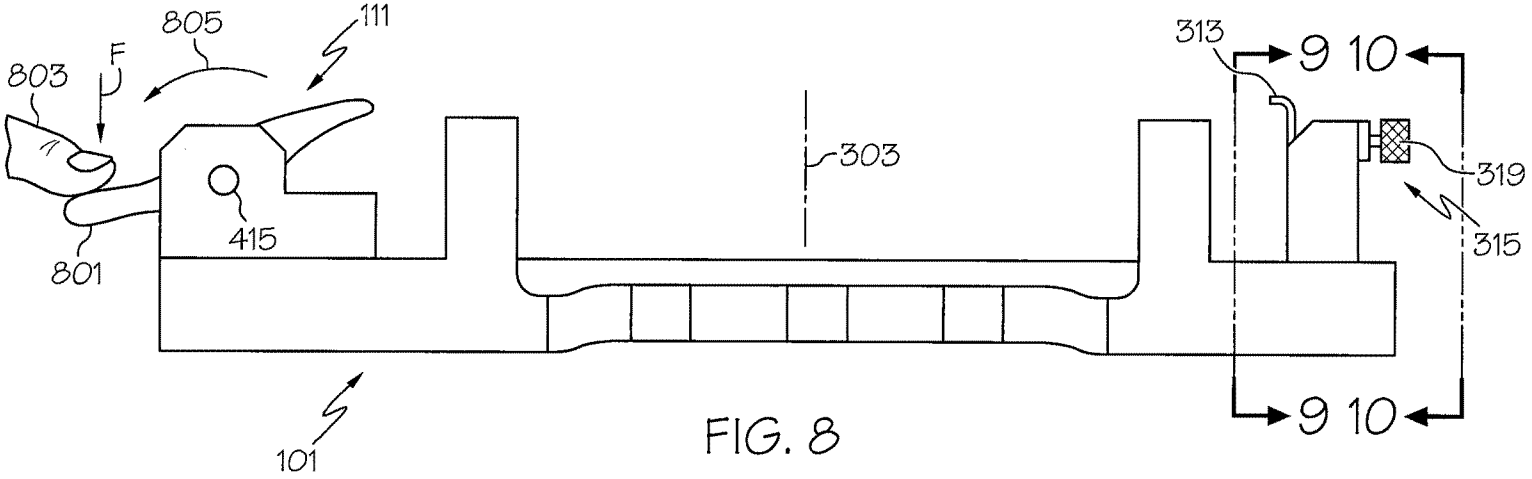
FIG. 8 is an assembled view of the separation apparatus of FIG. 3 in a fully open orientation.
Figure 10:
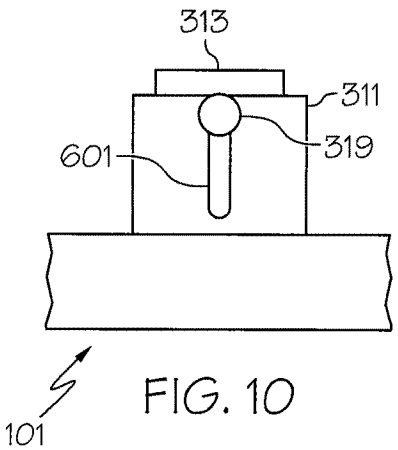
FIG. 10 is a sectional view of the separation apparatus along line 10-10 of FIG. 8.
Figure 9:
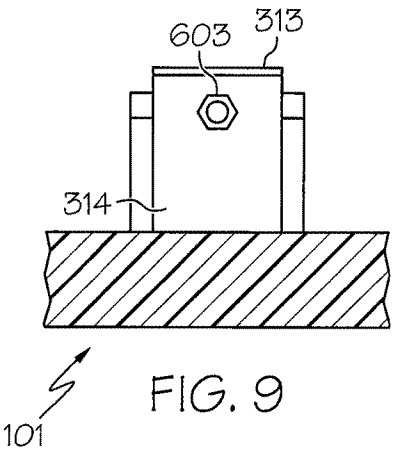
FIG. 9 is a sectional view of the separation apparatus along line 9-9 of FIG. 8.

As shown in FIG. 5, once assembled, the spring clip 105 can be biased by the springs 403 to pivot the clip member 111 along direction 501 about the pivot pin 415 to the fully clamped orientation. As further shown in FIG. 8, an operator may press down on a press portion 801 of the clip member 111 with a finger 803 to exert a downward force "F". The downward force "F" can be sufficient to counter the bias of the torsion springs 403 to cause a reverse pivot of the clip member 111 along direction 805 to achieve the fully open orientation shown in FIG. 8.

Figure 7:
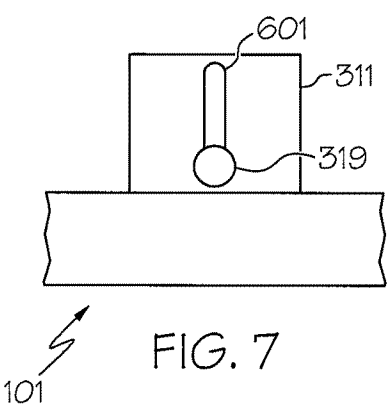
FIG. 7 is a sectional view of the separation apparatus along line 7-7 of FIG. 5.
Figure 6:
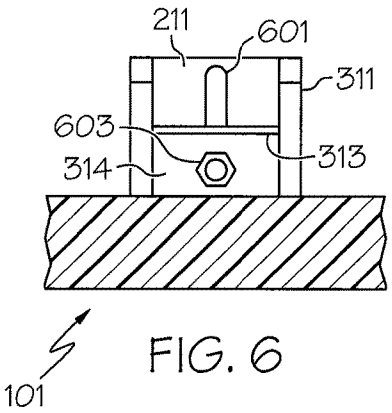
FIG. 6 is a sectional view of the separation apparatus along line 6-6 of FIG. 5.

FIG. 1 further shows the opposite clamp comprising the jaw mechanism 107. As shown in FIG. 3, the jaw mechanism 107 can include a clamp member 311 that may be part of the base 103. The jaw mechanism 107 can further include a locking device configured to lock the jaw 313 in a desired position. As shown in one example, the locking device can comprise a thumb screw 315 that may comprise a threaded shank 317 extending from a knurled knob 319. The threaded shank 317 can be threadingly received within a threaded nut 603 of a mounting member 314 of the jaw 313 shown in FIG. 6. The knurled knob 319 is configured to be easily grasped by the fingers of an operator tightening or loosening the thumb screw 315. As shown in FIGS. 6 and 7, the clamp member 311 include an elongated slot 601 extending along the mounting axis 303 and defining a travel path for the shank 317 of the thumb screw 315. As shown in FIG. 2, the clamp member 311 can further include an elongated groove 211. As shown in FIG. 6, the elongated groove 211 extends along the mounting axis 303 and defines a travel path for the mounting member 314 of the jaw 313.

In operation, an operator may loosen the thumb screw 315 by rotating the knurled knob 319. The jaw can then translate along the mounting axis 303 by way of the mounting member 314 traveling within the elongated groove 211 with the threaded shank 317 extending through the elongated slot 601. Once the desired height is achieved, the knurled knob 319 can again be engaged and rotated to lock the jaw 313 in position relative to the clamp member 311.

As further shown in FIG. 1, the separation apparatus 101 can further include a plurality of magnets that may be integrally mounted to the base. In further examples, as shown, the separation apparatus 101 may comprise a removable magnetic plate 115 comprising a plurality of magnets 117, wherein the magnetic plate 115 may be mounted to the base such that the magnetic plate 115 extends along the mounting surface 201 of the base 103. Providing removable mounting of the magnetic plate can allow a wide range of magnet configurations to be used depending on the desired characteristics of the sample plate. For illustration purposes, the magnetic plate 115 includes a plurality of individual magnets that are arranged in a matrix of rows and columns. Each magnet can include a circular cylindrical magnet with one end of the magnet 117 inserted within a corresponding socket 119 defined in the face 121 of the magnetic plate 115. As shown, in some examples, four seating apertures 123 may extend into the face 121 and may be arranged in an array about each magnet 117.

Figure 11:
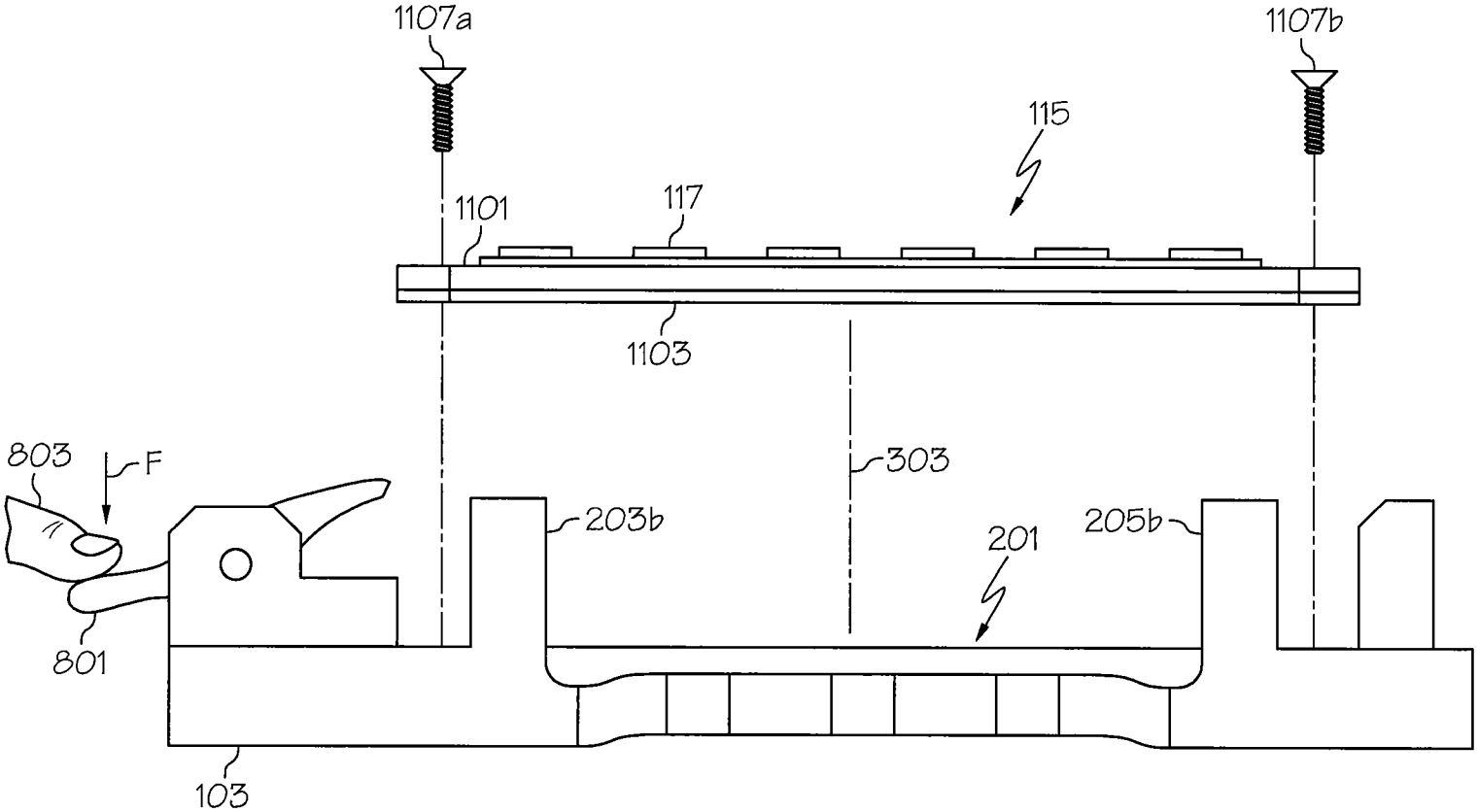
FIG. 11 is an assembled view of the separation apparatus in the fully open orientation with a magnetic plate being mounted to the mounting surface of the base.

As shown in FIG. 1, a plurality of plate screws 125 may be designed to attach a nonferrous substrate 1101 to a ferrous backplate 1103 shown in FIG. 11. The magnets extend within the sockets 119 without engaging the ferrous backplate 1103. However, the ferrous backplate 1103 can help draw the magnets within the sockets 119 and therefore maintain the magnets 117 in the desired position. FIG. 11 further shows one example method of mounting the magnetic plate 115 to the base 103. As shown, the jaw 313 and thumb screw 315 may be removed. Next, an operator may press down on the press portion 801 of the clip member 111 with finger 803 to exert the downward force "F" to achieve the fully open orientation shown in FIG. 11. While in the fully open orientation, the plate may then be traversed down in a direction of the mounting axis 303 such that the magnetic plate 115 is seated within the base 103. A pair of screws 1107*a*, 1107*b* can then fasten the magnetic plate 115 to the base 103.

As shown in FIG. 1, the base 103 may also include a first pair of stops 203*a*, 203*b* that may inhibit a movement of the magnetic plate relative to the mounting surface along the width "W" of the mounting surface 201. For example, as shown, the width "W" of the mounting surface can be defined between facing stop surfaces of the first pair of stops 203*a*, 203*b*. Moreover, the width of the magnetic plate 115 can closely match the width "W" of the mounting surface. As such, the width of the magnetic plate 115 can be trapped between the corresponding pair of stops 203*a*, 203*b* to inhibit, such as prevent movement of the magnetic plate relative to the mounting surface along the width "W" of the mounting surface 201. Although not required, the base 103 may also include another first pair of stops 205*a*, 205*b* that operate in a similar manner to the pair of stops 203*a*, 203*b*. In further examples, one pair of stops 203*a*, 205*b* may be provided without the other stops 205*a*, 203*b*. Likewise, in still further examples, one pair of stops 205*a*, 203*b* may be provided without the other stops 203*a*, 205*b*.

As further shown in FIG. 1, the base 103 may also include a second pair of stops 213*a*, 213*b* that can inhibit a movement of the magnetic plate 115 relative to the mounting surface 201 along the length "L" of the mounting surface 201. For example, as shown, the width "L" of the mounting surface can be defined between facing stop surfaces of the second pair of stops 213*a*, 213*b*. Moreover, the length of the magnetic plate 115 can closely match the length "L" of the mounting surface 201. As such, the length of the magnetic plate 115 can be trapped between the corresponding pair of stops 213*a*, 213*b* to inhibit, such as prevent movement of the magnetic plate relative to the mounting surface along the length "L" of the mounting surface 201.

Although not required, the second pair of stops 213*a*, 213*b* can include a corresponding one of the pair of clamps. For instance, as shown in FIG. 1, the stop 213*a* can include the spring clip 105 and the stop 213*b* can include the jaw mechanism 107.

Methods of separating magnetic material within a containment area of a sample plate will now be described with reference to FIGS. 12-15. Referring to FIG. 15, the method can begin with the step 1501 of providing the separation apparatus 101 including the base 103 defining the mounting surface 201 with the previously described length and width and the mounting surface 201 facing the outward direction 301 extending along the mounting axis 303 of the base 103. The separation apparatus further includes the plurality of magnets 117 positioned along the mounting surface 201 of the base 103. The plurality of magnets 117 may be integral with the base 103. In further examples, as shown, the removable magnetic plate 115 may be provided with the plurality of magnets 117 positioned along the mounting surface of the base. The separation apparatus further including the previously described pair of clamps including the spring clip 105 and the jaw mechanism 107.

Figure 12:
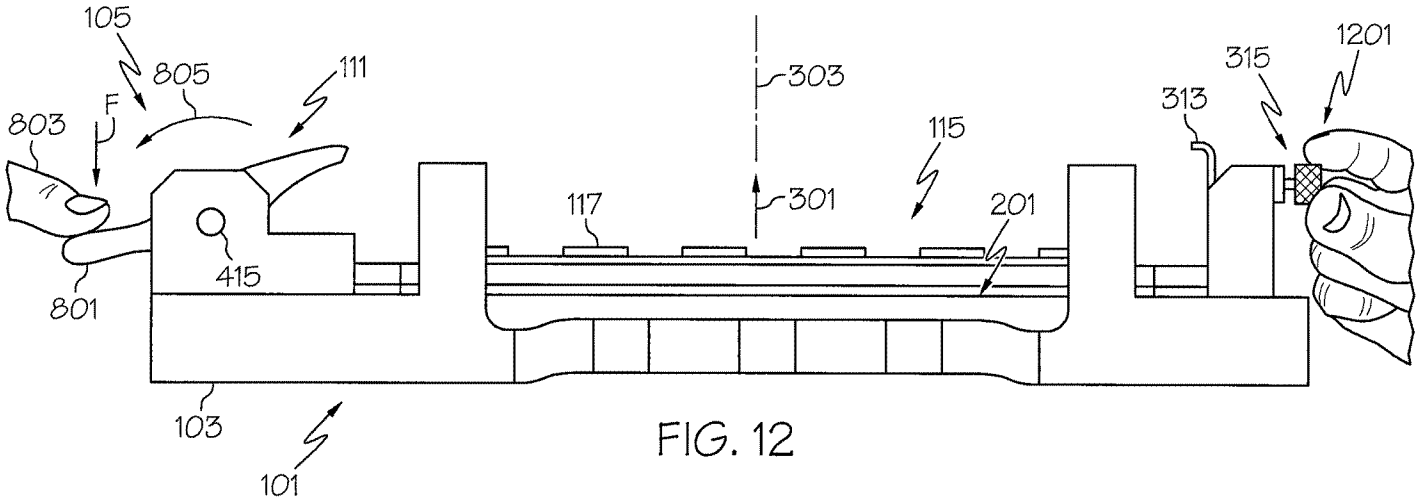
FIG. 12 is an assembled view of the separation apparatus in the fully open orientation with the magnetic plate being mounted to the mounting surface of the base.

The method can then proceed to the step 1503 of clamping the sample plate relative to the separation apparatus 101. For example, as shown in FIG. 12, fingers 1201 may be used to adjust the jaw 313 to the fully open orientation and then tighten the thumb screw 315 to lock the jaw 313 in position. Step 1503 can further include the step of engaging a press portion 801 of the spring clip to force the spring clip to pivot to a disengaged position. For example, as shown in FIG. 12, an operator can press a finger 803 down to apply the force "F" to pivot the clip member 111 along direction 805 about the pivot pin 415 such that the spring clip is in the fully open orientation.

Figure 13:
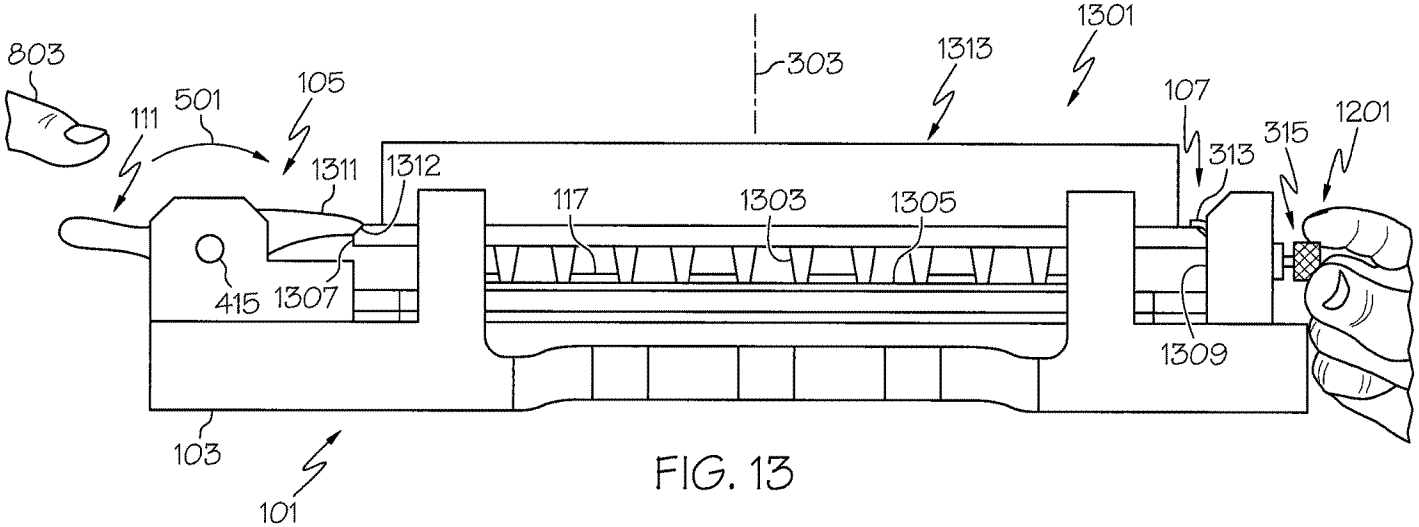
FIG. 13 illustrates the separation apparatus of FIG. 12 with a sample plate being mounted to the separation apparatus.

As shown in FIG. 13, step 1503 can further include the step of positioning a sample plate 1301 such that each containment area 1303 is positioned within a magnetic field of at least one of the magnets 117. In the illustrated example, the tips 1305 of the containment areas 1303 are seated within a corresponding one of the seating apertures 123 of the magnetic plate 115. As such, once seated, the engagement between the tips 1305 of the containment areas 1303 and the respective seating apertures 123 helps properly align the sample plate 1301 with the magnetic plate 115 and helps prevent subsequent shifting of the sample plate 1301 with respect to the magnetic plate 115 along the width "W" and the length "L" of the mounting surface 201.

As further shown in FIG. 13, the sample plate 1301 includes a first edge portion 1307 and a second edge portion 1309 opposed to the first edge portion 1307. The first edge portion 1307 is positioned with respect to the spring clip 105 and a second edge portion 1309 is positioned with respect to the jaw 313.

Step 1503 can further include the step of clamping the first edge portion 1307 of the sample plate 1301 with the spring clip 105 by releasing the spring clip to allow the spring clip to be biased to engage the first edge portion of the sample plate. Indeed, as shown in FIG. 13, the finger 803 can be moved away from the spring clip 105, wherein the bias of the torsion springs 403 cause the clip member 111 to rotate along direction 501 about the pivot pin 415 such that an engagement portion 1311 of the clip member 111 engages the first edge portion 1307 of the sample plate 1301.

Step 1503 can further include the step of clamping the second edge portion 1309 of the sample plate 1301 with the jaw mechanism 107 by translating a jaw 313 of the jaw mechanism 107 along the mounting axis 303 to engage the second edge portion 1309 of the sample plate 1301. The jaw 313 can then be locked from further translation along the mounting axis 303. For example, fingers 1201 can engage the thumb screw 315 to tighten the thumb screw and thereafter lock the jaw 313 in position.

Toolless clamping can further facilitate placement and mounting of the sample plate 1301 with respect to the separation apparatus 101. Indeed, an operator with two hands can clamp the first edge portion 1307 with one hand and then clamp the second edge portion 1309 with the other hand. In further examples, the operator can press down on the press portion 801 with one hand (as shown in FIG. 12) and then position the sample plate 1301 with the other hand while continuing to press down on the press portion 801 with the one hand. As such, the characteristics of the spring clip 105 and the jaw mechanism 107 can allow for unique and efficient placement and clamping of the sample plate 1301 without tools and without complication. Indeed, an operator may press down on the press portion 801 with one hand while positioning the sample plate 1301 with the other hand. Once positioned, the press portion 801 may be released to clamp the first edge portion 1307 in place. The operator can then use the other hand to tighten the jaw 313 with fingers 1201.

As discussed above, the steps of clamping the first edge portion and the second edge portion can be conveniently and quickly carried out without the use of tools. As such, toolless clamping can simplify the separation procedure and avoid tools that may otherwise contaminate the sample plate. Moreover, the spring clip 105 provides a fast way to clamp the edge portion of the sample plate. As the jaw mechanism 107 does not require constant application of force by the operator, the jaw mechanism 107 frees the other hand of the operator position the sample plate 1301 into the appropriate alignment. As such, one end of the sample plate 1301 can be quickly clamped to the separation apparatus 101 by way of the spring clip 105. The opposite end can thereafter be clamped in place by the operator once the spring clip 105 has been released to clamp the first edge portion 1307 of the sample plate 1301.

Moreover, the spring clip 105 and the jaw mechanism 107 can be designed to accommodate various sample plate configurations. For example, the adjustability of the spring clip and jaw mechanism of the separation apparatus 101 can also accommodate a relatively short sample plate wherein the edge portions of the sample plate are closer to the mounting surface 201 of the separation apparatus 101. Likewise, the adjustability of the spring clip and the jaw mechanism of the separation apparatus 101 can also accommodate a relatively tall sample plate wherein the edge portions of the sample plate are farther away from the mounting surface 201 of the separation apparatus 101.

Figure 14:
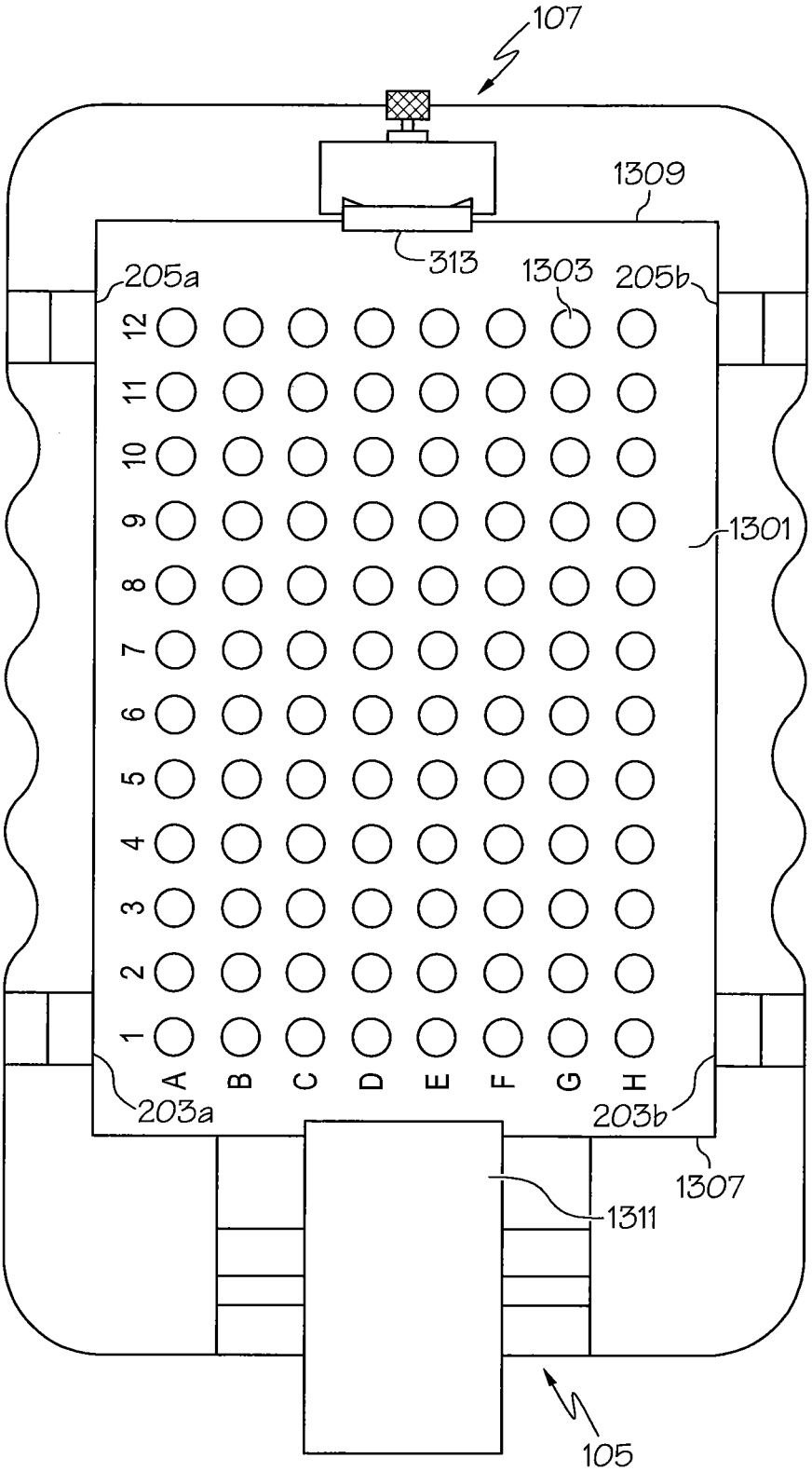
FIG. 14 is a top view of the separation apparatus with the mounted sample plate of FIG. 13.
Figure 15:
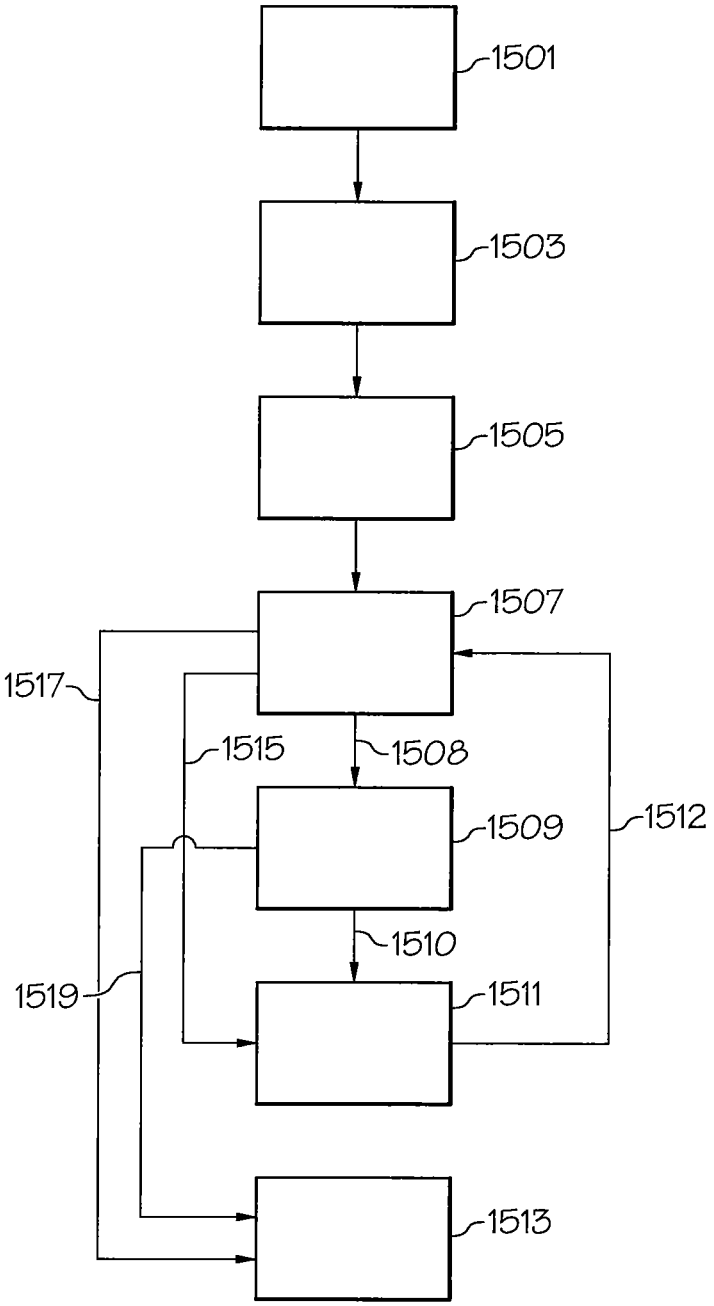
FIG. 15 is a flow diagram illustrating methods of separating magnetic material within containment areas of a sample plate in accordance with aspects of the disclosure.

As can be appreciated by FIG. 14, once clamped in place, the first pair of stops 203*a*, 203*b*, 205*a*, 205*b* can help inhibit, such as prevent movement of the sample plate 1301 relative to the mounting surface 201 along the width "W" of the mounting surface 201. Likewise, the jaw 313 and/or the engagement portion 1311 may further act as a stop to inhibit, such as prevent movement of the sample plate 1301 relative to the mounting surface 201 along the length "L" of the mounting surface 201. Indeed, the jaw 313 together with the mounting member 314 can act as a stop against the second edge portion 1309. As shown in FIG. 4, the engagement portion 1311 may include a groove 1312 or other surface shape configured to engage the first edge portion 1307 to help act as a stop against the first edge portion 1307.

Still further, once clamped in place, the pair of clamps 105, 107 is configured to inhibit movement of the sample plate 1301 relative to the mounting surface 201 in the outward direction 301 away from the mounting surface 201 in the outward direction 301. Indeed, for mounting, the spring clip 105 is configured to be biased to an engaged position to facilitate mounting of the sample plate 1301 relative to the mounting surface 201 to inhibit movement of the first edge portion 1307 of the sample plate 1301 relative to the mounting surface 201 in the outward direction 301. For releasing, the spring clip 105 can be pivoted to a disengaged position without tools to facilitate movement of the first edge portion 1307 of the sample plate 1301 relative to the mounting surface 201 in the outward direction 301. Moreover, the jaw mechanism 107 is configured inhibit movement of the second edge portion 1309 of the sample plate 1301 relative to the mounting surface 201 in the outward direction 301.

Referring to FIG. 15, the method can then include the step 1505 of separating the magnetic material within the containment areas 1303 of the sample plate 1301. For example, the containment areas may include fluid with magnetic material that may have been previously pipetted into the containment areas. In one example, the magnetic material may, have an affinity to certain material within the fluid desired to be separated. The magnetic fields created by magnets 117 act to draw the magnetic material, together with the material associated with the magnetic material against the inside surface of the containment areas.

Referring to FIG. 15, the method can then include the step 1507 of inverting the base 103 together with the sample plate 1301 such that liquid drains from the containment areas 1303 while magnetic material and any material having an affinity to the magnetic material remains in the containment areas under the influence of the respective magnets 117. For example, an operator may grasp the base 103 with one hand such that fingers of the operator engage one or both of the grip contours 207*a*, 207*b*. The operator may then simply manipulate the operator's hand to invert the base together with the sample plate. Gravity then draws the liquid from the containment areas 1303 while the magnetic material and associated purified material remains within the containment areas 1303 under the influence of the magnetic fields generated by the magnets 117.

As further illustrated in FIG. 15, as shown by arrow 1508, the method may then optionally proceed from step 1507 of inverting to the step 1509 of engaging an outer surface of the inverted sample plate against an absorbent material. For example, as shown in FIG. 13, the sample plate 1301 includes an outer surface 1313. Once inverted, the outer surface 1313 can be engaged with an absorbent material to help further draw fluid from the containment areas 1303. In some examples, the outer surface 1313 can be tapped against the absorbent material to still further help remove fluid from the containment areas 1303 while the magnetic material and associated purified material remains within the containment areas 1303 under the influence of the magnets 117.

As shown by arrow 1510, the method may proceed from the step 1509 of engaging the outer surface to a step 1511 of rinsing the magnetic material that remains within the containment areas 1303. For example, although not required, purified liquid may be placed within the containment areas 1303 to further remove impurities. As indicated by arrow 1512, the method can then revert back to the step 1507 of inverting. In one example, the step 1509 can be skipped, as indicated by arrow 1515. In further examples, as indicated by arrows 1517, 1519, the method can proceed from either step 1507 of inverting, or the step 1509 of engaging to a step 1513 of further processing. For example, the sample plate 1301 can be removed from the separation apparatus 101, and the material can be further processed.

Examples of the disclosure can enable researchers, for instance, to utilize bead-based chemistries to process many magnetic bead-based applications manually and reduce processing steps such as but not limited to nucleic acid purification and clean up, cell based assays, and antibody and protein purifications. The separation apparatus of the present disclosure can enable operators, for example, to perform magnetic bead based application manually and reduce pipetting steps, thereby simplifying the separation process. The separation device of the present disclosure can be designed to accommodate various sample plate formats (e.g., SBS microplate formats) and affix them in proximity, such as direct contact, with magnets positioned on the magnetic separation device. As such, washing fluids can be dispensed with a significantly reduced need of unnecessary pipetting steps or the unnecessary release of the sample plate from the separation apparatus. Embodiments of the separation apparatus can therefore comprise a universal separation apparatus that can accommodate various SBS microplate formats depending on the particular application. The operator will be able to affix the sample plate (e.g., SBS microplate) of desired volume with respect to the separation apparatus. The spring clip and jaw mechanism allows the operator to mount the sample plate to the hand-held separation apparatus without the need of any ancillary tools. The simplified clamping mechanism of affixing and removing the sample plate allows the operator to quickly and easily perform procedures not requiring the magnets such as mixing and incubation.

As such, aspects of the disclosure can help remove cells as efficiently as possible, in a short period of time and with maximum viability. It will be apparent to those skilled in the art that various modifications and variations can be made without departing from the spirit and scope of the claimed invention.

What is claimed is:

1. A separation apparatus comprising:

a base defining a mounting surface with a length and a width, the mounting surface facing an outward direction extending along a mounting axis of the base, the base including a first pair of stops configured to inhibit a movement of a sample plate relative to the mounting surface along the width of the mounting surface;

at least one magnet mounted with respect to the mounting surface of the base; and a pair of clamps configured for toolless operation, wherein the pair of clamps are spaced apart from one another along the length of the mounting surface and configured to inhibit movement of the sample plate relative to the mounting surface in the outward direction away from the mounting surface while the sample plate is positioned over the mounting surface and the at least one magnet.

2. The separation apparatus of claim 1, wherein the pair of clamps includes a spring clip configured to be biased to an engaged position to facilitate mounting of the sample plate relative to the mounting surface to inhibit movement of the sample plate relative to the mounting surface in the outward direction, wherein the spring clip can be pivoted to a disengaged position without tools to facilitate movement of the sample plate relative to the mounting surface in the outward direction.

3. The separation apparatus of claim 1, wherein the pair of clamps includes a jaw configured to translate along the mounting axis, and a locking device configured to lock the jaw in a desired position to inhibit movement of the sample plate relative to the mounting surface in the outward direction.

4. The separation apparatus of claim 3, wherein the locking device comprises a thumb screw.

5. The separation apparatus of claim 4, wherein the base includes a clamp member including an elongated slot extending along the mounting axis and defining a travel path for a shank of the thumb screw.

6. The separation apparatus of claim 3, wherein the base includes a clamp member including an elongated groove extending along the mounting axis and defining a travel path for a mounting member of the jaw.

7. The separation apparatus of claim 1, further including a magnetic plate comprising the at least one magnet, wherein the magnetic plate is mounted to the base such that the magnetic plate extends along the mounting surface of the base.

8. The separation apparatus of claim 7, wherein the magnetic plate is removably mounted to the base.

9. The separation apparatus of claim 7, wherein the first pair of stops inhibit a movement of the magnetic plate relative to the mounting surface along the width of the mounting surface.

10. The separation apparatus of claim 7, wherein the base includes a second pair of stops that inhibit a movement of the magnetic plate relative to the mounting surface along the length of the mounting surface.

11. The separation apparatus of claim 10, wherein each of the second pair of stops include a corresponding one of the pair of clamps.

12. The separation apparatus of claim 1, further comprising a sample plate mounted with respect to the base with the pair of clamps, wherein the sample plate is positioned over the mounting surface and the at least one magnet.

13. A separation apparatus comprising:

a base defining a mounting surface with a length and a width, the mounting surface facing an outward direction extending along a mounting axis of the base, the base including a first pair of stops configured to inhibit a movement of a sample plate relative to the mounting surface along the width of the mounting surface;

at least one magnet mounted with respect to the mounting surface of the base; and a pair of clamps configured for toolless operation, wherein the pair of clamps are spaced apart from one another along the length of the mounting surface and configured to inhibit movement of the sample plate relative to the mounting surface in the outward direction away from the mounting surface in the outward direction, wherein a first one of the pair of clamps includes a spring clip configured to be biased to an engaged position to facilitate mounting of the sample plate relative to the mounting surface to inhibit movement of a first edge portion of the sample plate relative to the mounting surface in the outward direction, wherein the spring clip can be pivoted to a disengaged position without tools to facilitate movement of the first edge portion of the sample plate relative to the mounting surface in the outward direction, and wherein a second one of the pair of clamps includes a jaw configured to translate along the mounting axis, and a locking device configured to lock the jaw in a desired position to inhibit movement of a second edge portion of the sample plate relative to the mounting surface in the outward direction while the sample plate is positioned over the mounting surface and the at least one magnet.

14. The separation apparatus of claim 13, further including a magnetic plate comprising the at least one magnet, wherein the magnetic plate is mounted to the base such that the magnetic plate extends along the mounting surface of the base.

15. The separation apparatus of claim 14, wherein the first pair of stops inhibit a movement of the magnetic plate relative to the mounting surface along the width of the mounting surface.

16. The separation apparatus of claim 13, further comprising a sample plate mounted with respect to the base with the pair of clamps, wherein the sample plate is positioned over the mounting surface and the at least one magnet.

17. A method of separating magnetic material within containment areas of a sample plate comprising the steps of:

(I) providing a separation apparatus including a base defining a mounting surface with a length and a width, the mounting surface facing an outward direction extending along a mounting axis of the base, the separation apparatus further including at least one magnet positioned with respect the mounting surface of the base, and the separation apparatus further including a pair of clamps including a spring clip and a jaw mechanism;

(II) engaging a press portion of the spring clip to force the spring clip to pivot to a disengaged position;

(III) positioning the sample plate over the mounting surface and the at least one magnet, wherein each containment area is positioned within a magnetic field of the at least one magnet, wherein the sample plate includes a first edge portion and a second edge portion opposed to the first edge portion, and wherein the first edge portion is positioned with respect to the spring clip and a second edge portion positioned with respect to the jaw;

(IV) clamping the first edge portion of the sample plate with the spring clip by releasing the spring clip to allow the spring clip to be biased to engage the first edge portion of the sample plate;

(V) clamping the second edge portion of the sample plate with the jaw mechanism by translating a jaw of the jaw mechanism along the mounting axis to engage the second edge portion of the sample plate, and then locking the jaw from further translation along the mounting axis; and (VI) inverting the base together with the sample plate such that liquid drains from the containment areas while magnetic material remains in the containment areas under the influence of the at least one magnet.

18. The method of claim 17, further comprising the step of engaging an outer surface of the inverted sample plate against an absorbent material after step (VI).

19. The method of claim 17, further comprising the step of rinsing the magnetic material that remains after step (VI).

20. The method of claim 17, wherein step (IV) and step (V) are carried out without tools.

21. The method of claim 20, wherein an operator with two hands carries out step (IV) with one hand and then carries out step (V) with the other hand.

22. The method of claim 17, wherein an operator with two hands carries out step (II) with one hand, and then carries out step (III) with the other hand while carrying out step (II).

* * * * *